United States Patent [19]

Olding

[11] Patent Number: 5,009,047

[45] Date of Patent: Apr. 23, 1991

[54] CHIMNEY CROWN MOLD

[76] Inventor: Michael Olding, 4 Gilmore Ct., Fairfield, Ohio 45014

[21] Appl. No.: 523,014

[22] Filed: May 14, 1990

Related U.S. Application Data

[63] Continuation of Ser. No. 277,880, Nov. 30, 1988, abandoned.

[51] Int. Cl.[5] ..... E04H 12/28; F23L 17/12

[52] U.S. Cl. ..... 52/218; 52/301; 52/310; 52/244; 249/17

[58] Field of Search ..... 249/15, 17, 19, 83, 249/90, 141, 160, 205, DIG. 3; 52/300, 301, 310, 244, 218

[56] References Cited

U.S. PATENT DOCUMENTS

| | | | |
|---|---|---|---|
| Re. 18,492 | 6/1932 | Friedrich | 52/300 |
| 1,088,060 | 2/1914 | Carter | 249/17 |
| 1,504,264 | 8/1924 | Nelson et al. | 249/17 |
| 1,524,050 | 1/1925 | Monten et al. | 249/17 |
| 1,591,558 | 7/1926 | Pike | 249/17 |
| 1,617,141 | 2/1927 | Anderson | 52/300 |
| 1,860,240 | 5/1932 | Friedrich | 52/300 |
| 2,250,733 | 7/1942 | Swenson | 52/300 |
| 2,365,854 | 12/1944 | Albaugh | 52/300 |
| 2,438,528 | 3/1948 | Wilhelm et al. | 52/310 |
| 4,004,386 | 1/1977 | Diffenderfer | 52/300 |
| 4,413,453 | 11/1983 | Witte | 52/300 |
| 4,601,073 | 7/1986 | Methot | 52/300 |
| 4,625,343 | 12/1986 | Bumgarner, Sr. | 52/300 |
| 4,735,395 | 4/1988 | Dahowski | 249/DIG. 3 |

*Primary Examiner*—James C. Housel

[57] ABSTRACT

A mold is provided for use in forming a chimney crown on the top of a chimney shell. The mold includes four side sections and four corner sections which are assembled together to form a complete unit. Each side section and each corner section has a base for contacting a top surface of the chimney shell and a band extending downwardly from the base for contacting an outer side surface of the chimney shell. Since part of this base extends outwardly beyond the chimney shell, the chimney crown overhangs the chimney shell preferably in a cantilever manner. Each side section of the mold also has an upper leg and a lower leg extending from the base at the outer end thereof. A hook trough extends inwardly from the upper leg into the chimney crown for anchoring the mold and for carrying water to drainage holes in the corner sections of the mold. A rope may be disposed in the hook trough to act as a wick for drawing excess moisture from the chimney crown. The mold effectively deflects moisture that infiltrates the chimney crown away from the chimney shell thereby preventing structural and cosmetic damage to the chimney shell.

7 Claims, 2 Drawing Sheets

CHIMNEY CROWN MOLD

This is a continuation of application Ser. No. 07/277,880 filed Nov. 30, 1988, now abandoned.

BACKGROUND OF THE INVENTION

This invention relates generally to molds and forms for casting cement and, in particular, to a chimney crown mold.

Throughout the United States the conventional method for casting chimney crowns is to premix cement with sand and then place this mixture directly on top of the chimney shell which normally consists of brick, block or stone. Because masonry materials such as brick, block and stone absorb water quite readily, newly formed chimney crowns dry out and set rapidly. This rapid setting causes large cracks to develop within the crown which allows water to enter the crown and be absorbed by the chimney shell. The water fills the capillaries of the material forming the chimney shell, and during the cold winter months, it freezes within the chimney shell material and expands. This expansion breaks apart the chimney shell and within a few years severe damage is evident often requiring expensive rebuilding of the upper part of the chimney shell.

Current methods for casting chimney crowns leave the outer ends of the crown flush with the outside of the chimney shell. As water is deflected off the chimney crown it runs down the outer surfaces of the chimney shell. Since the chimney shell is not protected from this water run off, it absorbs too much water which fills the capillaries of the shell material and freezes in the winter thereby eventually deteriorating the chimney shell and requiring expensive rebuilding.

Due to problems associated with current casting methods, an excessive amount of water is allowed to enter the chimney shell with no provisions for exiting the excess water. This situation allows an accumulation of water in the chimney shell and, as already stated, causes severe damage and deterioration as a result of the freeze and thaw cycle.

One of the most important problems facing the chimney industry is the cost of labor. Because the bulk of all cost in the construction industry is labor, any saving that can be created through product development is critical. Currently there is no product available on the market that addresses the problems of effective chimney crown installation. As a result, chimney shells are deteriorating at an unusually high rate.

SUMMARY OF THE INVENTION

It is an object of the present invention to provide an easily installed, cost effective preformed mold for the casting of chimney crowns that will effectively remove rain and snow from chimney crowns thus minimizing the amount of moisture that may be absorbed by chimney shells. Such absorption of moisture is the leading cause of structural and cosmetic damage to chimney shells.

The chimney crown mold of the present invention has a unique design and material makeup. It is preferably formed of P.V.C. plastic with an ultraviolet inhibitor. The mold partially covers the top and outer side surfaces of the chimney shell and since it is manufactured of a tough durable plastic which will not absorb water, no water can enter the chimney shell through the mold thus preventing the capillaries of the shell material from filling with water and causing severe freeze damage in the cold winter months.

Since the chimney crown mold of the present invention prevents contact between the chimney shell and the chimney crown, moisture is not absorbed by the chimney shell thus allowing the chimney crown to hydrate normally which minimizes the shrinkage and cracking that occurs in chimney crowns which helps to greatly reduce the amount of water that enters the chimney shell.

Because the chimney crown mold of the present invention is actually used in forming the chimney crown, it can be extended outwardly beyond the chimney shell. Since the mold is used in a cantilever manner, it is extended about 1.25 inches outwardly past the chimney shell. This allows rain and snow running off the chimney crown to drip past the chimney shell onto the roof or ground minimizing the amount of water that enters the chimney shell through absorption and helping protect the chimney shell from the damaging effects of the freeze and thaw cycle.

The chimney crown mold of the present invention includes a unique hook trough that has a two fold purpose. First, it provides an anchor extending into the chimney crown helping to stabilize the mold after the forming of the crown. Secondly, it carries infiltrating water along the mold and then out drains on the mold. Because the mold drains are open to the atmosphere, evaporation can occur at a fast pace and the wicking action of a rope disposed in the hook trough will help remove water more effectively. The hook trough provides more stability for the mold allowing the angle of the slope of the crown to be greatly increased. The steeper the sloping angle of the chimney crown the faster the water will exit from the chimney, and the faster the water can drain the less chance it will have of being absorbed.

The chimney crown mold of the present invention solves the problem of diverting water away from the chimney shell and because it is designed to be put together simply and fast, it will create savings for all installers thus not only providing good performance in addressing chimney problems but also lowering the cost of proper chimney crown installation which ultimately brings savings to the consumer.

DESCRIPTION OF THE PREFERRED EMBODIMENT

Figure 1:
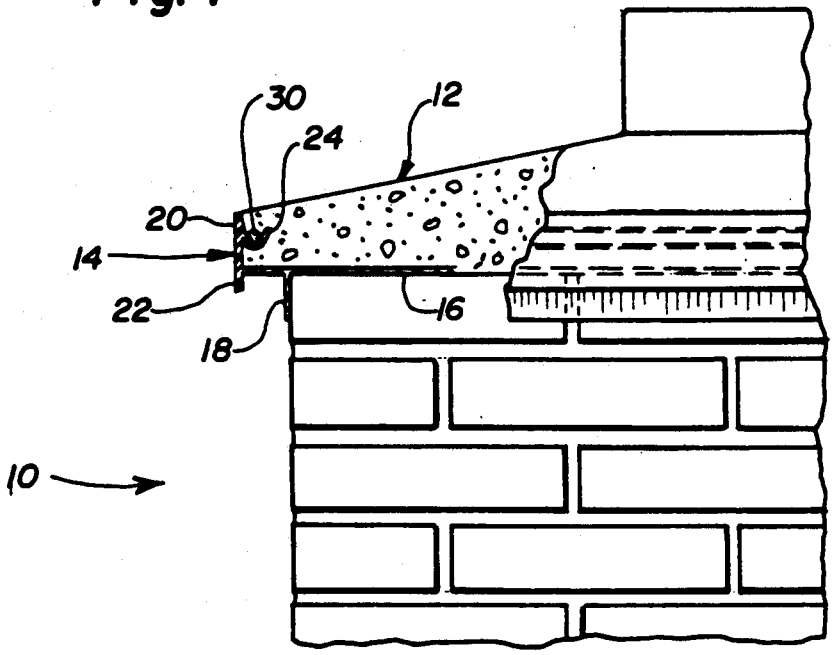
FIG. 1 is a side elevation view of a chimney, partly in section, embodying a chimney crown mold according to the present invention in use.
Figure 2:
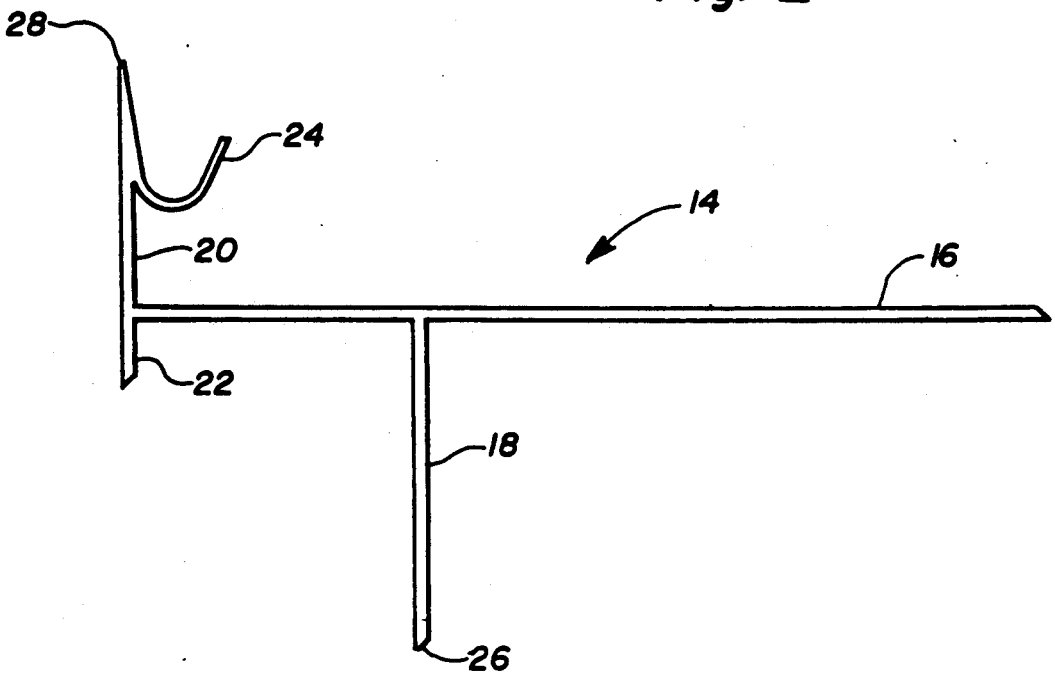
FIG. 2 is an enlarged side elevation view of a side section of the chimney crown mold shown in FIG. 1.
Figure 3:
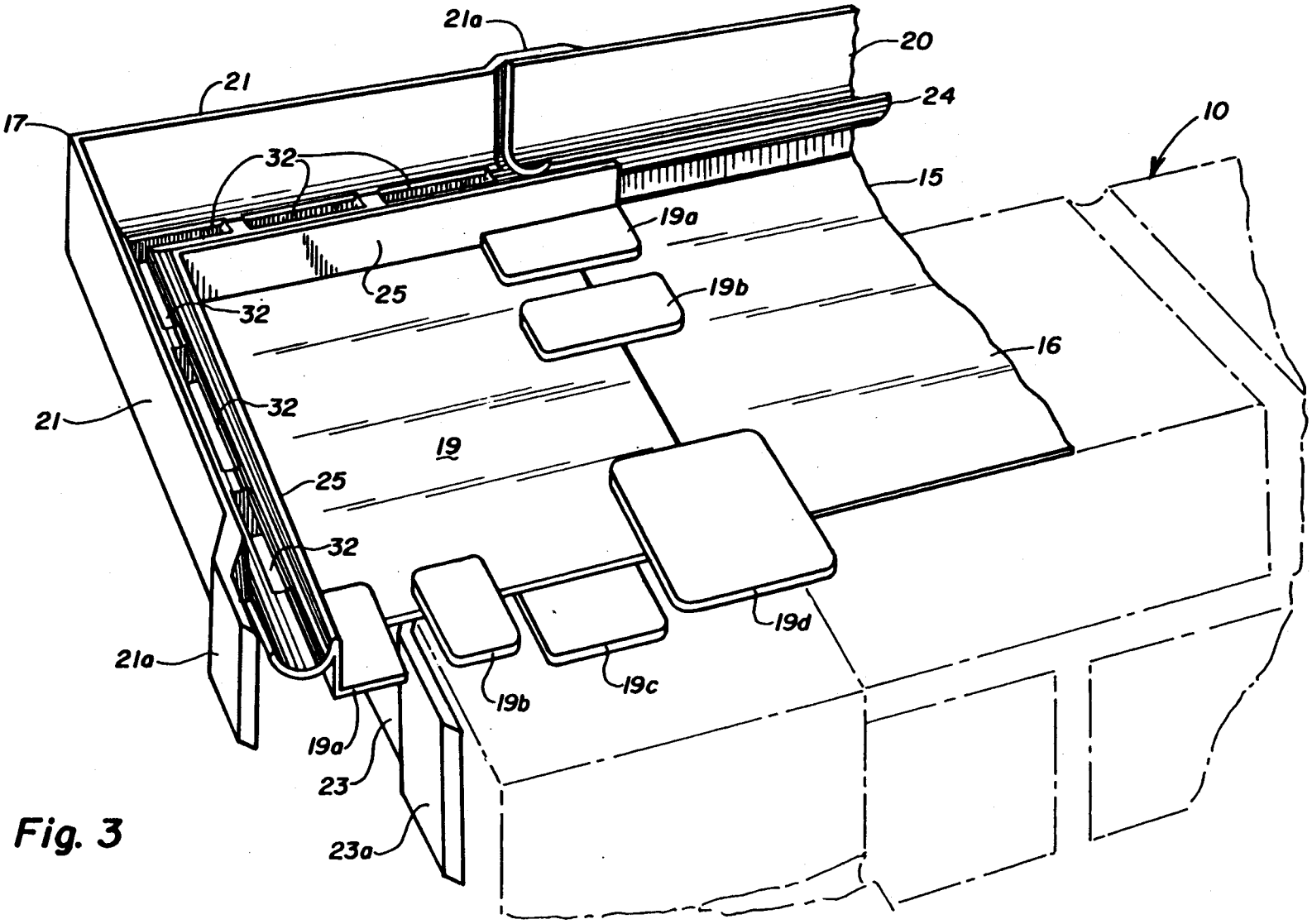
FIG. 3 is a perspective view of a corner section and a portion of a side section of the chimney crown mold.

Referring to FIG. 1, a chimney shell 10 is formed of brick, block or stone. A chimney crown 12 formed of cement and sand is disposed on top of the chimney shell 10. According to the preferred embodiment of the present invention, a chimney crown mold 14 is installed between the chimney shell 10 and the chimney crown 12. The mold 14 consists of four side sections and four corner sections which are cut to desired length and glued together to form a complete rectangular unit. The side sections are made by an extrusion molding process, and the corner sections are molded with a 90 degree corner. As best seen in FIGS. 2 and 3, each side section 15 is comprised of a base 16, a band 18, an upper leg 20, a lower leg 22 and a hook trough 24. Each corner section 17 as shown in FIG. 3 is comprised of a base 19, a combined upper and lower leg 21, a band 23, and a trough 25. Tabs 19*a*, 19*b*, 19*c*, 19*d* formed on the base 19 and tabs 21*a*, 23*a* formed on the upper and lower leg 21 and on the band 23 are used in assembling the side sections 15 and the corner sections 17.

The base 16 contacts the top surface of the chimney shell 10 fully covering the top surface of the chimney shell 10. Because the mold 14 is intended to be used in a cantilever manner, the band 18 acts as a stop for the base 16 providing an overhang of the chimney crown 12. The base 16 supports the band 18 as well as the upper and lower legs 20, 22. Since the band 18 contacts the outer side surfaces of the chimney shell 10, it effectively acts as a vapor barrier preventing excess evaporation of the chimney crown 12. In addition, the band 18 prevents water infiltrating through the top of chimney crown 12 from being absorbed by the chimney shell 10.

The band 18 extends downwardly substantially perpendicular to the base 16 and, as mentioned above, forms a stop for the base 16 allowing only a predetermined amount of the mold 14 to extend beyond the outer face of the chimney shell 10. This assures enough extension of the chimney crown 12 for satisfactory water deflection while providing the proper overhang effect. On the inside bottom edge of the band 18 is a 45 degree chamfer 26 which allows blowing rain to drip away from the chimney shell 10.

The upper leg 20 extends upwardly substantially perpendicular to the outer end of the base 16 while supporting the hook trough 24. The upper leg 20 cooperates with the base 16 to contain the chimney crown 12 and also forms a predetermined depth for the casting of the chimney crown 12. On the upper edge of the upper leg 20 is a 45 degree chamfer 28 which helps drain water from the chimney crown 12. The lower leg 22 acts as a water diverter preventing water that runs off the chimney crown 12 from dripping underneath the mold 14. Furthermore, the lower leg 22 hides drainage holes 32 formed in the corner sections 17 of the mold 14 that allow water to drain out.

The hook trough 24 has several purposes. First, it reinforce and stiffens the upper leg 20 against flexing when the chimney crown 12 is formed. Secondly, the hook trough 24 provides an anchor for the mold 14 extending inwardly from the upper leg 20 into the chimney crown 12 and forming a tight bond with the chimney crown 12. Lastly, the hook trough 24 carries infiltrating water that enters the chimney crown 12 and drains it at the corner sections 17 of the mold 14 where the drainage holes 32 are located. Rope 30 preferably formed of cotton may be disposed in the hook trough 24 to act as a wick for drawing excess moisture from the chimney crown 12 to the drainage holes 32 in the mold 14.

In use, the chimney crown mold 14 of the present invention is installed between the chimney crown 12 and the chimney shell 10 so that the chimney crown 12 overhangs the chimney shell 10 preferably in a cantilever manner. The mold 14 deflects water which infiltrates the chimney crown 12 away from the chimney shell 10 thus reducing or helping alleviate water infiltration into the chimney shell 10. The mold 14 comprises base 16 which contacts a top surface of the chimney shell 10, band 18 extending downwardly substantially perpendicular to the base 16 for contacting an outer side surface of the chimney shell 10, upper leg 20 extending upwardly substantially perpendicular to the outer end of the base 16 and cooperating with the base 16 to contain the chimney crown 12, hook trough 24 extending inwardly from the upper leg 20 into the chimney crown 12 serving to anchor the mold 14 and to carry water which infiltrates the edges of the chimney crown 12, and lower leg 22 extending downwardly substantially perpendicular to the outer end of the base 16 to prevent water that runs off the chimney crown 12 from dripping underneath the mold 14. Wick 30 may be disposed in the hook trough 24 for drawing excess moisture from the chimney crown 12 to drainage holes 32 in the mold 14.

In the preferred embodiment of the chimney crown mold 14, base 16 is approximately 4.25 inches long overall with about 1.25 inches between band 18 and the outer end of base 16, band 18 is 1.50 inches long, and upper leg 20 and lower leg 22 have a combined length of 1.75 inches. The thickness of base 16, band 18, upper leg 20 and lower leg 22 is about 0.10 inches.

What is claimed is:

1. A chimney crown mold for use in combination with a chimney which includes a chimney shell and a chimney crown disposed on top of said chimney shell, said chimney crown mold being adapted for installation between said chimney shell and said chimney crown so that said chimney crown overhangs said chimney shell, and wherein said chimney crown mold deflects water which infiltrates said chimney crown away from said chimney shell thus reducing or helping alleviate water infiltration into said chimney shell, said chimney crown mold comprising:

a base which contacts and covers a top surface of said chimney shell, and a band extending downwardly substantially perpendicular to said base for contacting an outer side surface of said chimney shell, said base having an inner end and an outer end, said band being located between said inner and outer ends but closer to said outer end than to said inner end;

an upper leg extending upwardly from said base adjacent the outer end thereof without forming any notches, grooves or recesses between said upper leg and said base, said upper leg cooperating with said base to contain said chimney crown; and a lower leg extending downwardly from said base adjacent the outer end thereof to prevent water that runs off said chimney crown from dipping underneath said chimney crown mold.

2. The chimney crown mold of claim 1, wherein said chimney crown mold further comprises a hook trough extending inwardly from said upper leg into said chimney crown, said hook trough serving to anchor said chimney crown mold and to carry water which tends to infiltrate edges of said chimney crown.

3. The chimney crown mold of claim 1, wherein said chimney crown mold further comprises a chamfer on the upper edge of said upper leg to help drain water from said chimney crown.

4. The chimney crown mold of claim 3, wherein said chimney crown mold further comprises a chamfer on the inside bottom edge of said lower leg to allow water to drip away from said chimney shell.

5. The chimney crown mold of claim 2, further comprising a wick disposed in said hook trough for drawing excess moisture from said chimney crown.

6. The chimney crown mold of claim 2, further comprising drainage holes in said chimney crown mold for draining water carried by said hook trough.

7. The chimney crown mold of claim 1, wherein said chimney crown mold includes at least one side section and at least one corner section..

* * * * *